US006832481B2

(12) United States Patent
Koenig et al.

(10) Patent No.: US 6,832,481 B2
(45) Date of Patent: Dec. 21, 2004

(54) TURBINE ENGINE FUEL NOZZLE

(75) Inventors: Michael Herbert Koenig, Oviedo, FL (US); Bernd Prade, Muelheim an der Ruhr (DE)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/255,892

(22) Filed: Sep. 26, 2002

(65) Prior Publication Data

US 2004/0060297 A1 Apr. 1, 2004

(51) Int. Cl.[7] ..... F23R 3/30

(52) U.S. Cl. ..... 60/737; 60/748; 60/747; 431/182; 431/183

(58) Field of Search ..... 60/737, 746, 747, 60/748, 39.091, 39.11; 431/182, 183, 346

(56) References Cited

U.S. PATENT DOCUMENTS

| | | | | | |
|---|---|---|---|---|---|
| 5,251,447 | A | | 10/1993 | Joshi et al. | |
| 5,317,864 | A | | 6/1994 | Shorb et al. | |
| 5,407,347 | A | * | 4/1995 | Bortz | 431/183 |
| 5,461,865 | A | * | 10/1995 | Snyder et al. | 60/737 |
| 5,471,840 | A | * | 12/1995 | Lovett | 60/737 |
| 5,778,676 | A | * | 7/1998 | Joshi et al. | 60/737 |
| 5,813,232 | A | * | 9/1998 | Razdan et al. | 60/737 |
| 5,901,555 | A | | 5/1999 | Mandai et al. | |
| 6,038,861 | A | | 3/2000 | Amos et al. | |
| 6,047,551 | A | | 4/2000 | Ishiguro et al. | |
| 6,070,411 | A | * | 6/2000 | Iwai et al. | 60/737 |
| 6,094,916 | A | | 8/2000 | Puri et al. | |
| 6,158,223 | A | | 12/2000 | Mandai et al. | |
| 6,179,608 | B1 | | 1/2001 | Kraemer et al. | |
| 6,438,961 | B2 | * | 8/2002 | Tuthill et al. | 60/776 |
| 6,655,145 | B2 | * | 12/2003 | Boardman | 60/737 |

FOREIGN PATENT DOCUMENTS

| | | | |
|---|---|---|---|
| EP | 1 174 662 A | | 1/2002 |
| JP | 09119639 | | 5/1997 |
| JP | 09-119639 | * | 5/1997 |

* cited by examiner

*Primary Examiner*—Ted Kim

(57) ABSTRACT

A performance-enhancing fuel nozzle is disclosed. The nozzle suitable for use in combustors which combine high-swirl-number combustion in a pilot zone with low-swirl-number combustion in a main combustion zone. The nozzle includes a fuel delivery member adapted for fluid communication with a fuel source and a flow conditioning member having a fuel exit port. The fuel exit port is in fluid communication with the fuel supply and is adapted to ensure that the recirculation region adjacent the nozzle tip remains flame free. In one aspect of the invention, the fuel concentration profile of the nozzle is characterized by a radially-outward region that is flammable and a radially-inward region that is substantially non-flammable. In another aspect of the invention, the fuel exit port being is disposed a radially-outward portion of the flow conditioning member. In another aspect of the invention, the flow conditioning member is characterized by a swirl number lower than about 0.5. In another aspect of the invention, the exit are high-momentum jets, having a design ratio pressure of greater than about 1.1. In another aspect of the invention, the nozzle is part of a combustor which has a high-swirl-number combustion in a pilot zone and low-swirl-number combustion in a main combustion zone.

17 Claims, 3 Drawing Sheets

TURBINE ENGINE FUEL NOZZLE

FIELD OF THE INVENTION

This invention relates generally to the field of fuel nozzles and, more particularly, to a combustor and associated fuel nozzle having improved fuel concentration profile characteristics.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design includes a centralized pilot nozzle and several main fuel injector nozzles arranged circumferentially around the pilot nozzle. With this design, the nozzles are arranged to form a pilot flame zone and a mixing region. During operation, the pilot nozzle selectively produces a stable flame which is anchored in the pilot flame zone, while the main nozzles produce a mixed stream of fuel and air in the above-referenced mixing region. The stream of mixed fuel and air flows out of the mixing region, past the pilot flame zone, and into a main combustion zone, where additional combustion occurs. Energy released during combustion is captured by the downstream components to produce electricity or otherwise do work.

In one version of this type of combustor, two types of combustion occur: high-swirl-combustion occurs in the pilot flame zone, with low-swirl-number combustion occurring in the main combustion zone. As is known in this field, high-swirl-number combustion is characterized by relatively-compact flames, with high rates of rotation and relatively-low rates of longitudinal propagation. Low-swirl-number combustion, conversely, is characterized by flames which are relatively more spread out. By combining high swirl number combustion in the pilot flame zone with low swirl number combustion elsewhere, this type of combustor provides stable and predictable operation and a high degree of monitorability. As a result, this type of combustor is suitable for use across a wide range of operating conditions. Additionally, by providing a combustion scheme which yields a wide-spread distribution of energy within the combustion chamber, this type of combustor is also resistant to thermo-acoustic excitations. These combustors also present a relatively-long pre-combustion mixing path for the fuel and air which helps ensure even-temperature burning and reduced emissions levels. Accordingly, this type of combustor is a popular choice for use in industrial turbine engines.

In order to ensure optimum performance of this type of combustor, it is generally preferable that the internal fuel-and-air streams are well-mixed, to avoid localized, fuel-rich regions. Combustion of over-rich pockets of fuel and air leads to high-temperature combustion that produces high levels of unwanted NOx emissions. As a result, efforts have been made to produce combustors with essentially-uniform distributions of fuel and air. Swirler elements, for example, are often used to produce a stream of fuel and air in which air and injected fuel are evenly mixed.

Unfortunately, while attempts to reduce emissions by uniformly distributing fuel and air are effective in some cases, they are not suitable with all combustors. For example, combustors like the ones described above, which combine high-swirl-number combustion in a pilot zone with low-swirl-number combustion in a main combustion zone, can actually suffer increases in unwanted emissions and acoustic resonance problems when used with nozzles that produce uniform distributions of fuel and air. In this type of combustor uniformly distributed mixtures of fuel and air lead to flame holding at the main nozzle tips which, in addition to increasing unwanted emissions and acoustic problems, also introduces the need for nozzle tip cooling and increases the risk of dangerous flashback. Therefore, while efforts to improve performance through uniformly distributing fuel and air are effective in some settings, they can actually reduce the performance of some combustors.

Accordingly, there remains a need for a performance-enhancing nozzles suitable for use in combustors which combine high-swirl-number combustion in a pilot zone with low-swirl-number combustion in a main combustion zone. The nozzle should eliminate combustion outside the mixing zone immediately downstream of the nozzle, without negatively impacting the overall performance of the combustor. The nozzle should produce a radially-biased fuel concentration profile which reduces the tendency for flame holding at the nozzle tip. The nozzle should also provide the desired fuel concentration profile over a wide range of operating conditions, without regard to fluctuating fuel and air inputs.

SUMMARY OF THE INVENTION

The instant invention is a performance-enhancing nozzle suitable for use in combustors which combine high-swirl-number combustion in a pilot zone with low-swirl-number combustion in a main combustion zone. The nozzle includes a fuel delivery member adapted for fluid communication with a source of fuel and a flow conditioning member that includes at least one fuel exit port which is in fluid communication with the fuel supply and adapted to ensure that the region adjacent the nozzle tip remains flame free. In one aspect of the invention, the nozzle produces a fuel concentration profile characterized by a radially-outward region that is flammable and a radially-inward region that is substantially non-flammable. In another aspect of the invention, the flow conditioning element includes a radially-inboard first portion and a radially outward second portion, with the fuel exit ports being disposed in the second portion. In another aspect of the invention, the flow conditioning element is characterized by a swirl number lower than about 0.6. In another aspect of the invention, the exit ports may be characterized as high-momentum, having a design ratio pressure of greater than about 1.1. In another aspect of the invention, the nozzle is part of a combustor which produces high-swirl-number combustion in a pilot zone and low-swirl-number combustion in a main combustion zone.

Accordingly, it is an object of the present invention to provide a fuel nozzle that eliminates combustion outside a mixing zone immediately downstream of the nozzle, without negatively impacting the overall performance of the combustor.

It is another object of the present invention to provide a nozzle that produces a radially-biased fuel concentration profile which reduces the tendency for flame holding at the nozzle tip.

It is yet a further object of the present invention to provide a nozzle that produces the desired fuel concentration profile over a wide range of operating modes, without regard to fluctuating nozzle inlet conditions.

It is also an object of the present invention to provide a nozzle that is compatible with previously-installed combustors, allowing the nozzle to be used in retrofit operations.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
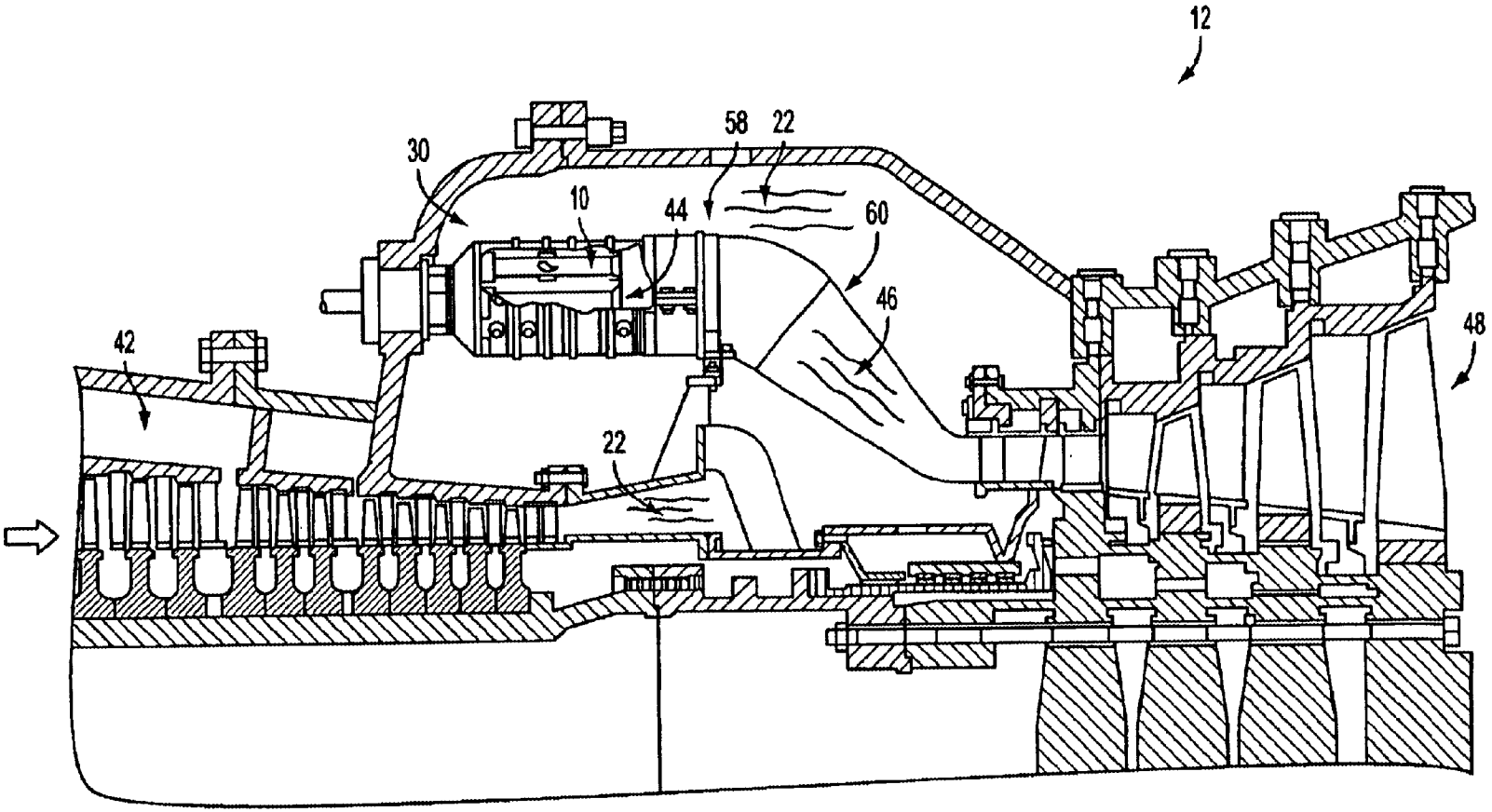
FIG. 1 is a side elevation of a combustion engine employing the nozzle of the present invention.

Reference is now made in general to the Figures, wherein the nozzle 10 of the present invention is shown. With reference to FIG. 1, the nozzle 10 of the present invention will be described in use within an industrial combustion turbine engine 12. By way of overview, and with additional reference to FIG. 2, the nozzle 10 includes a centralized fuel delivery member 14 which is in fluid communication with a source of fuel (not shown). Several flow conditioning members 16 are disposed circumferentially around the fuel delivery member 14, and each of the flow conditioning members includes one or more fuel exit ports 18. The fuel exit ports 18 are, in turn, fluidly coupled with the fuel deliver member 14. Fuel 20 passes through the exit ports 18, and joins air 22 travelling over the flow conditioning members 16 to form a mixture 24 of fuel and air. As described more fully below, the fuel exit ports 18 and flow conditioning members 16 ensure that the air and fuel mixture 24 has a concentration profile 26 that substantially reduces or prevents the formation of flames at the downstream end 28 of the fuel delivery member 14. The nozzle 10 of the present invention will now be described in further detail.

Figure 2:
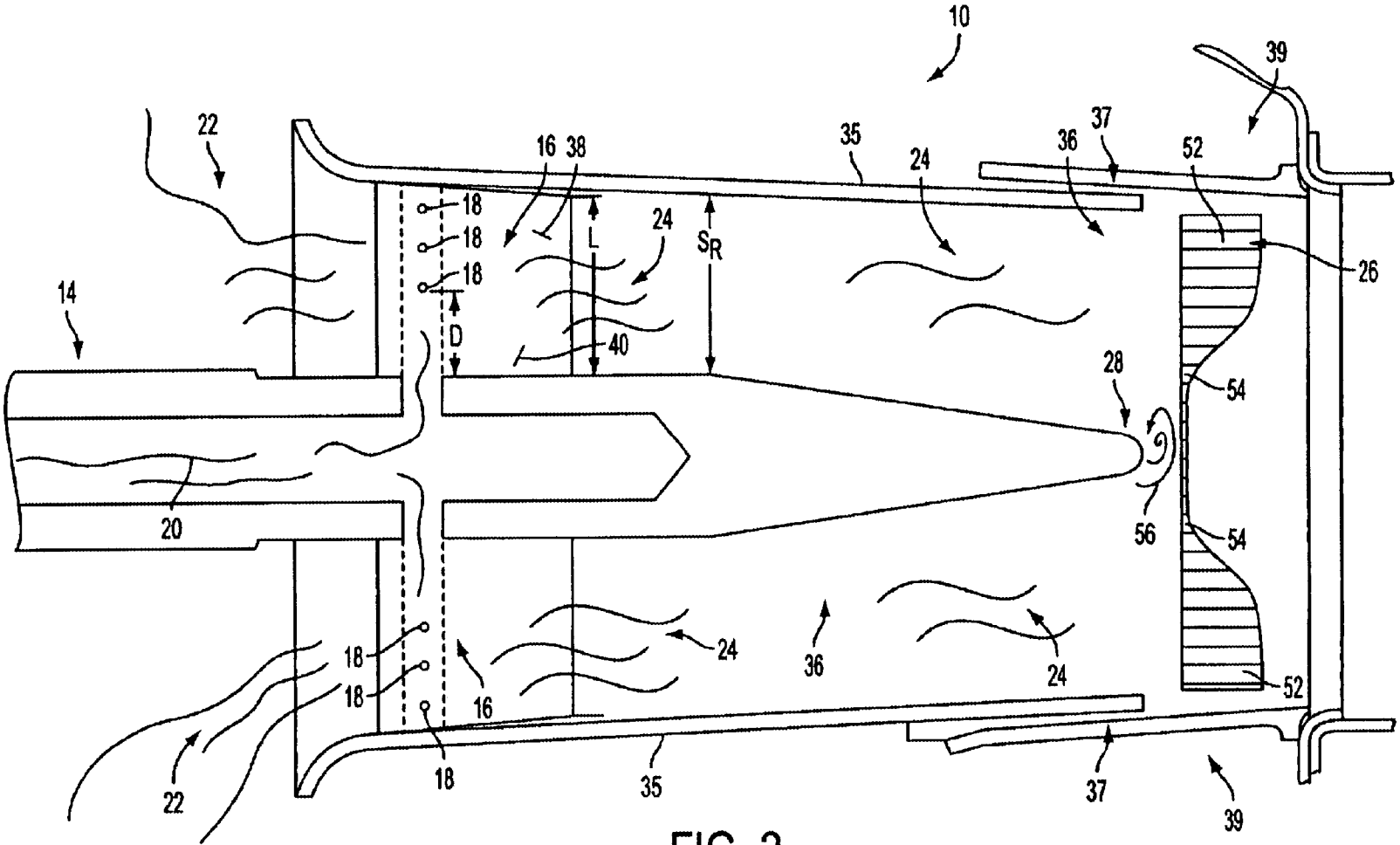
FIG. 2 is a side sectional view of the nozzle of the present invention.
Figure 3:
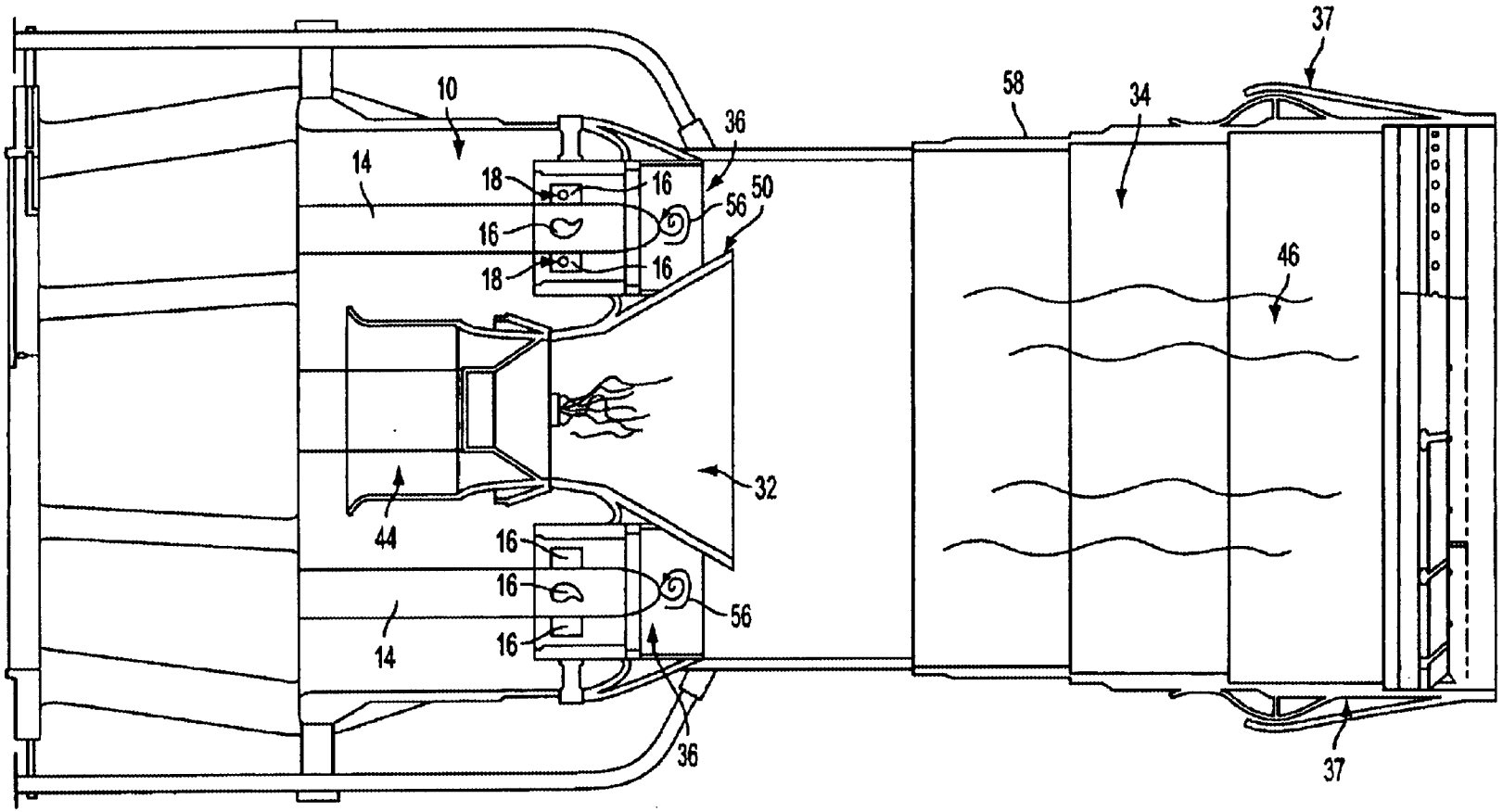
FIG. 3 is a partial side elevation of a combustor using the nozzle shown in FIG. 2.

With continued reference to FIG. 2, and with additional reference to FIG. 3, the nozzle 10 of the present invention has features which make it especially well-suited for use as a main nozzle within a combustion system 30 that combines high-swirl-number combustion in a pilot flame zone 32 and low-swirl-number combustion in a main combustion zone 34. The nozzle 10 includes an elongated fuel delivery member 14 which resembles a tube characterized by a downstream tip 28. In one embodiment, the fuel delivery member 14 is mounted within a nozzle sleeve 35, and the flow conditioning members 16 extend between the delivery member and the sleeve. In the present embodiment, the flow conditioning members 16 and fuel delivery member 14 may be formed as an integral unit; however, the flow conditioning members may be formed separately, if desired. A flashback annulus 37, which allows fluid communication between the inlet air 22 and the mixing region 36 is also included and helps lower flame-holding tendencies at the downstream end 39 of the nozzle sleeve 35.

With continued reference to FIGS. 2 and 3, the flow conditioning members 16 are airfoil-shaped swirlers that extend radially outward from the fuel delivery member 14. With particular reference to FIG. 2, the flow conditioning members 16 include preferably three fuel exit ports 18 positioned on each side so as to produce a radially-biased fuel concentration profile 26 in a mixing zone 36 located between the nozzle 10 and the main combustion zone 34. More particularly, the fuel exit ports 18 are located within a radially-outward portion 38 of the flow conditioning members 16; the radially-inward portion 40 of the flow conditioning members extending between the radially-outward portion and fuel delivery member contains no fuel exit ports. The distance D between the radially-innermost fuel exit port 18 and the fuel delivery member is within the range of about 30% to 40% of the passage height $S_R$. The fuel exit ports 18 are spaced to produce a nearly even fuel distribution within the radially outward portion 38, but other suitable distributions such as biased toward the center of the passage may be employed as desired. The fuel exit ports 18 are spaced to produce a nearly-uniform fuel distribution within the radially-outward portion 38, but other suitable distributions such as biased toward the middle of the annulus (to enhance performance of the flashback annulus 37) may be employed as desired. It is also noted that the flow conditioning members 16 need not have an airfoil-shaped cross section, other suitable shapes which increase the turbulence, including static mixing elements may be used, as desired. It is also noted that not all flow conditioning members 16 need to include three fuel exit ports 18 on each side; more or fewer ports may be included, and some conditioning members may have no exit ports.

In keeping with the objects of the invention, the fuel exit ports 18 are sized and shaped to produce streams of fuel 20 having relatively-high momentum. For example, the fuel exit ports 18 are characterized by a design pressure of about 1.2, with the preferred design pressure being between about 1.1 to about 1.4. The fuel exit ports 18 are generally formed normal to the surface of flow conditioning member 16, but this may be modified if desired, and the ports may have different or uniform diameters in order to achieve the required mixing profile within the circumferential variation over the operating range. The use of high-momentum jets is not required; however, injecting fuel in this manner provides enhanced stability of the fuel concentration profile 26, making the fuel distribution less sensitive to varying nozzle inlet conditions.

In one embodiment, the flow conditioning members 16 are swirlers shaped to impart low-swirl-number flow to fluids such as a mixture 24 of air 22 supplied by a compressor section 42, and fuel introduced by the fuel delivery member 14. Although swirlers having a variety of properties may be used, swirlers that induce flow having a swirl number in the range between about 0.2 to about 0.6 are desired.

In this application, the term swirl number refers to the known measurement term which quantifies the ratio between longitudinal momentum and rotational momentum for a given stream of fluid at the nozzle exit plane. In the present embodiment, the flow conditioning members contribute to fluid flow in the mixing zone and main combustion zones characterized by a swirl number of about 0.4.

With particular reference to FIGS. 1 and 3, the nozzle 10 of the present invention acts as a main nozzle in a staged combustion system 30. During operation, several, for example eight, main nozzles 10 are grouped together with a pilot nozzle 44 to combust a mixture 24 of fuel 20 and air 22. As discussed above, the products of this combustion provide a high-energy working fluid 46 that is transferred downstream to a turbine section 48 of an associated engine 12, where energy is extracted to do further work. A combustor liner 58 downstream of the main and pilot nozzles 10,44 bounds the main combustion zone and interfaces with a transition section 60 to guide the products of combustion 46 into the turbine section 48.

In the combustion system 30 shown in FIG. 3, the pilot fuel nozzle 44 produces a stable flame within a pilot flame zone 32, which may be partially bounded by a boundary cone 50, as shown. As fuel 20 and air 22 flow downstream from the main nozzles 10, they flow through a mixing region 36, where they form a mixture 24 having a radially-biased fuel concentration profile 26 (which is shown in FIG. 2). With this arrangement, the radially-outward portion 52 of the fuel-and-air mixture 24 flowing near the nozzle sleeve 35 is flammable, while the radially-inward portion 54 of the mixture is not flammable. As a result, the nozzle 10 of the present invention does not support combustion in the recirculation zone 56 located adjacent the nozzle downstream end or tip 28. In one embodiment, the flammable, radially-outward portion 52 of the fuel-and-air mixture 24 occupies approximately the outer 75% of the radial spacing between the center of the passage and the outside of the passage. The fuel concentration profile 26 need not occupy the outer 75 percent, and may occupy an amount ranging from 60 to 90%. With this arrangement, the recirculation zone 56 remains essentially flame-free, while low-swirl-number combustion is supported in the main combustion zone 34. With continued operation, the fuel-and-air mixture 24 travels downstream until it contacts the pilot flame zone 32 which provides an anchoring flame and feeds continued combustion in the main combustion zone 34. The nozzle 10 of the present invention may be used in a new engine 12, or may be installed into an existing combustion system 30 during a retrofit operation.

It is to be understood that while certain forms of the invention have been illustrated and described, it is not to be limited to the specific forms or arrangement of parts herein described and shown. It will be apparent to those skilled in the art that various changes, including modifications, rearrangements and substitutions, may be made without departing from the scope of this invention and the invention is not to be considered limited to what is shown in the drawings and described in the specification. The scope of the invention is defined by the claims appended hereto.

What is claimed is:

1. A nozzle for a combustor comprising:

a fuel delivery member adapted for fluid communication with a source of fuel, said fuel delivery member including a solid and closed downstream end;

a swirl-inducing flow conditioning member disposed adjacent said fuel delivery member, said flow conditioning member including a fuel exit port in fluid communication with said fuel delivery member;

wherein said flow conditioning member is adapted to dispense fuel in a manner which produces a radially-biased fuel concentration profile within the nozzle characterized by a radially-outward region that is flammable and a radially-inward region that is substantially non-flammable, whereby said fuel concentration profile is effective to ensure that a region adjacent said fuel delivery member downstream end is substantially flame-free.

2. The nozzle of claim 1, wherein said flow conditioning member extends radially from said fuel delivery member.

3. The nozzle of claim 1, wherein said nozzle forms a recirculation zone adjacent said fuel delivery member downstream end, and wherein said fuel concentration profile is adapted to ensure said recirculation zone is substantially non-flammable.

4. The nozzle of claim 1, wherein the conditioning element includes a radially-inward first portion and a radially-outward second portion, said fuel exit port being disposed only within said second portion.

5. The nozzle of claim 4, wherein said flow conditioning member includes a plurality of fuel exit ports disposed within said conditioning element second portion.

6. The nozzle of claim 4, wherein said radially-outward second portion is spaced apart from a longitudinal axis of said fuel delivery member by a distance of about 30% to 40% of a radial height of said flow conditioning member.

7. The nozzle of claim 4, wherein said flow conditioning member is adapted to induce a downstream fluid flow characterized by a swirl number, wherein said swirl number is lower than about 0.6.

8. The nozzle of claim 1, wherein said fuel exit ports are characterized by a design pressure ratio effective to introduce fuel in a manner characterized by momentum effective to ensure said fuel concentration profile remains substantially consistent as pre-selected operational conditions vary.

9. The nozzle of claim 8, wherein said design pressure ratio is higher than about 1.1.

10. The nozzle of claim 9, wherein said design pressure ratio is within a range of about 1.1 to about 1.4.

11. The nozzle of claim 8, wherein the conditioning element includes a radially-inward first portion and a radially-outward second portion, said fuel exit port being disposed only within said second portion.

12. The nozzle of claim 8, wherein the conditioning element includes a radially-inward first portion and a radially-outward second portion, said radially-outward second portion being spaced apart from a longitudinal axis of said fuel delivery member by a distance of about 30% to 40% of a radial height of said flow conditioning member.

13. The nozzle of claim 8, wherein said flow conditioning member adapted to induce a downstream fluid flow characterized by a swirl number, wherein said swirl number is lower than about 0.6.

14. A combustor comprising:

a source of fuel;

a liner member defining an interior region, said interior being characterized by a pilot flame zone and a main combustion zone;

a pilot nozzle disposed adjacent a first end of said liner member, said pilot nozzle being in fluid communication with said source of fuel and adapted to provide a pilot flame to said pilot flame zone;

a main nozzle disposed adjacent said first end of said liner member, said main nozzle including a fuel delivery member in fluid communication with a source of fuel; said fuel delivery member including a solid and closed downstream end;

a swirl-inducing flow conditioning member disposed adjacent said fuel delivery member, said flow conditioning member including a fuel exit port in fluid communication with said fuel delivery member, wherein said flow conditioning member and said flow conditioning member produce a mixture having a fuel concentration profile within the main nozzle characterized by a radially-outward region that is flammable and a radially-inward region that is substantially non-flammable, whereby said mixture combusts in said main combustion zone and whereby said fuel concentration profile is effective to ensure that a region adjacent said fuel delivery member downstream end is substantially flame-free.

15. The combustor of claim 14, wherein said flow conditioning member is adapted to induce a downstream fluid flow characterized by a swirl number, wherein said swirl number is lower than about 0.6.

16. The combustor of claim 14, wherein said fuel exit port is characterized with respect to said fuel delivery member by a design pressure ratio effective to introduce fuel in a manner characterized by momentum effective to ensure said fuel concentration profile remains substantially consistent as pre-selected operational conditions vary.

17. The nozzle of claim 16, wherein said design pressure ratio is higher than about 1.1.

* * * * *